United States Patent [19]

Boehringer

[11] 4,286,927

[45] Sep. 1, 1981

[54] HYDRAULIC POWER TRANSFER UNIT

[75] Inventor: Wilfred E. Boehringer, Fullerton, Calif.

[73] Assignee: McDonnell Douglas Corporation, Lakewood, Calif.

[21] Appl. No.: 933,558

[22] Filed: Aug. 14, 1978

[51] Int. Cl.[3] ..... F04B 1/16; F04B 17/00; F04B 35/00

[52] U.S. Cl. ..... 417/271; 91/503

[58] Field of Search ..... 74/60; 91/180, 502, 91/503; 417/271

[56] References Cited

U.S. PATENT DOCUMENTS

| | | | |
|---|---|---|---|
| 1,019,521 | 5/1912 | Pratt | 91/502 |
| 1,781,068 | 11/1930 | Michell | 91/502 |
| 2,498,679 | 2/1950 | Hall | 74/60 |
| 2,581,973 | 4/1952 | Richardo | 91/502 |
| 2,845,030 | 7/1958 | Febvre et al. | 417/271 |
| 3,262,395 | 7/1966 | Morando | 417/271 |
| 3,314,367 | 4/1967 | Livers | 417/271 |
| 3,344,715 | 10/1967 | Wilson | 91/180 |
| 3,353,450 | 11/1967 | Killick et al. | 91/503 |
| 3,354,786 | 11/1967 | Bedford | 91/180 |
| 3,596,569 | 8/1971 | Wisbey | 91/180 |
| 3,890,064 | 6/1975 | Boehringer et al. | 417/237 |
| 4,168,652 | 9/1979 | Bick | 417/271 |

FOREIGN PATENT DOCUMENTS

| | | | |
|---|---|---|---|
| 44-16052 | 7/1969 | Japan | 91/503 |
| 231918 | 4/1925 | United Kingdom | 91/503 |
| 241631 | 12/1925 | United Kingdom | 91/503 |
| 526972 | 9/1940 | United Kingdom | 74/60 |

*Primary Examiner*—William L. Freeh

*Attorney, Agent, or Firm*—George W. Finch; Donald L. Royer; Walter J. Jason

[57] ABSTRACT

A multi-piston motor pump for the transfer of hydraulic energy from one hydraulic system to another without the transfer of fluid therebetween. A plurality of pistons are maintained in predetermined phase by a nutator mechanism or spider which is then used to rotate a shaft connected to valving means for the pistons which controls fluid to, or away from the pistons in a predetermined manner. The motor pump unit, in large measure, is made possible by improved couplings between the spider and the pistons that provide complete motion freedom, yet maintain definite position between the pistons and the spider. In addition, a rotary valve arrangement is disclosed which reduces the start-up friction loads of the unit to a minimum while being relatively reliable and easy to mechanize.

5 Claims, 10 Drawing Figures

HYDRAULIC POWER TRANSFER UNIT

BACKGROUND OF THE INVENTION

The invention belongs generally to a class of hydraulic power transfer units and particularly relates to such units having pistons mechanically arranged in a fixed phase relationship with each other to transfer energy from one hydraulic system to another without transferring fluid therebetween. Such hydraulic power transfer units find particular application in connection with modern aircraft where they are used to provide hydraulic system load sharing to maintain system redundancy particularly during takeoff and landing. In the past it has been conventional practice to install multiple and separate hydraulic systems to provide enough redundancy so that the failure of one or more components in a system does not cause catastrophic problems to the aircraft. Each separate system is usually powered from different prime movers, such as from different aircraft engines or auxiliary power units. It is particularly important during takeoff and landing that such redundancy be provided so that the failure of one hydraulic system does not disrupt some of the services required to be operated such as landing gear retraction which requires a large amount of hydraulic energy. To protect against this contingency, transfer motor pumps have been installed between hydraulic systems to permit the transfer of hydraulic energy from one system to another in either direction without the transfer of hydraulic fluid between the systems. This latter requirement that no fluid be transfered between systems assures that the intact system is protected from fluid loss and contamination.

A typical power transfer unit used heretofore in large aircraft consists of two conventional rotary pumps connected together, usually on a single shaft. Unfortunately, this type of motor pump is highly inefficient with very poor performance. Hence these motor pumps generate a substantial amount of heat which must be dissipated by additional equipment. Furthermore, this equipment is relatively noisy which, in some instances, is distressful to some of the passengers and, due to poor performance, cannot be placed passively between two hydraulic systems so that the equipment is immediately available for use. The noise and heat must be accommodated during landing and takeoff but at other times the heretofore conventional units are switched off. This is undesirable because additional complexity must be added to the circuitry to automatically transfer energy from one hydraulic system to another thereafter.

U.S. Pat. No. 3,890,064 entitled "Reciprocating Transfer Pump," of which the present applicant is a co-inventor, provides an improved power transfer device. However, this improved device requires relatively complex valving to effect power transfer in a given direction and to effect an automatic change of direction of the power transfer upon the loss of pressure in one system. In addition, the unit is heavy and considerable complexity is required to remove the significant pressure ripple generated during the valving cycle of the pump. This pressure ripple is undesirable in that it tends to over stress the surrounding hydraulic system. Hence, it is evident that there is still a further need for improved power transfer units to overcome these disadvantages.

There has also been a need for improvement in the coupling between the nutater and pistons in nutater-type pumps and motors. Previously, a certain amount of slop had to be tolerated between the spider and the piston. Such devices, where the relative positioning of the spider and pistons is not positive, are not practical in the present invention as they cannot endure the stressful environment of an aircraft hydraulic system while keeping the valving precise so that the efficiency of the power transfer remains high.

The start-up friction of a motor pump device usually is high due to pressure loads across the valving means thereof. This high start-up friction is undesirable since in aircraft applications, once the pressure in one system has dropped a relatively small amount, it is desirable that hydraulic energy be transferred thereinto and heretofore proposed valving schemes having flat plate valves have resulted in differential pressures in the range of 1200 to 1500 psi (8000 to 12000 kPa) between systems to start the transfer of energy or a very complex mechanism to balance the forces in the valve means.

BRIEF SUMMARY OF THE INVENTION

The basic building block of the present invention is a multi-piston reciprocating unit which may be utilized either as a motor to convert hydraulic pressure energy into the reciprocating motion of pistons or as a pump to convert the reciprocating motions of the pistons back into hydraulic energy. A pair of these units with their corresponding pistons, mechanically connected, when properly phased and connected to appropriate valving provide a reversible hydraulic power transfer unit, the unit connected to the hydraulic system with higher pressure acting as a motor and the other unit as a pump.

The motor or pump unit of the present invention is comprised of a plurality of pistons symmetrically arranged about and parallel to a central axis and slidable in a corresponding plurality of cylinders. The relative positions of the pistons are mechanically controlled by control means whose preferred form is a nutater mechanism or spider. The spider has a plurality of coplanar radial arms, each of which is coupled to a corresponding piston. The nutater forms an angle with a central shaft. Nutation thereof causes the central shaft to rotate and at the same time maintains the pistons in a predetermined phase relationship with each other.

Since the ends of the spider, which engage the pistons, each move in a complex pattern approximating a figure "8", suitable means must be provided to positively couple the spider ends to the pistons. This is accomplished, in the present invention, by providing cylindrical spider ends at the periphery of the spider which are aligned with the axis of nutation thereof. Each of such cylindrical spider ends are positioned to slide in a transverse bore in a cylindrical connector bushing which in turn is mounted for rotation and transverse movement in a cylinder connected to the piston. This arrangement allows the ends of the spider to move in their figure "8" pattern while restraining the pistons thereto at all times so that the force transmitting surfaces therebetween are always in contact and no impact loads are ever caused by the connection. Without this feature, it is unlikely that a practical device of the sort described could be constructed.

Although many valving arrangements, such as flat-plate valves may be used to provide suitable valving means for the present invention, the preferred construction utilizes a rotary valve, especially constructed, so that it can withstand the alternating loads applied thereacross. Such rotary valves are preferable to the flat-plate valves in that their start-up friction can be more easily controlled and they are scalable over a wide size range of motor pump applications.

Two basic reciprocating units are usually mechanically coupled back to back. In this case, the corresponding pistons of the two units are mechanically connected to be moved in unison, hence, only a single mechanical piston phase control means (spider) is required. When pressure applied to the pistons of one side is greater than the pressure applied to the pistons of the other side, the unit with the high pressure hydraulic fluid operates as a motor and the other a pump thereby transferring energy from one side to the other. When the combined unit is connected to two separate hydraulic systems, this accomplishes transfer of hydraulic energy from system to system without the transfer of fluid. The two units automatically reverse when the pressure differential therebetween reverses, and due to a predetermined operating friction thereacross, will not operate at all if a predetermined differential pressure is not applied thereacross. Therefore, the device can be left in a standby mode indefinitely and it will not operate until the predetermined differential pressure is applied thereacross, at which point, it will automatically transfer energy from the higher pressure system to the lower pressure system. The physical proportion in the unit which controls or sets this startup differential pressure, and which is very important to the unit's detail design, is the ratio of the piston area to the valve's startup friction torque. A large piston area relative to the valve friction will start at a lower differential pressure than one with a small piston area. However, for an optimun design at a given flow capacity, there is a practical piston size limitation, since the weight of the unit is also a factor, especially when designed for aircraft use. The mechanical phasing of the plurality of pistons provides for automatic damping of the piston discharge. Since the pistons are constrained by the nutater mechanism, their velocity assumes a sinusoidal function with a maximum velocity at mid stroke and a low velocity toward the end of the stroke. Also, since the nutater is used only to maintain the pistons and the valve means in proper phase relationship and not to connect energy between the systems which is accomplished by the back-to-back pistons, the heavy nutater and bearings normally employed in nutater type motors or pumps are not required.

It is, therefore, an object of the present invention to provide a unit for transferring hydraulic energy from one hydraulic system to another which operates automatically in response to a predetermined pressure differential present between the two systems.

Another object is to provide a hydraulic energy transfer unit which does not generate excess pressure ripple either in the giving or receiving system.

Another object is to provide means for reducing the complexity of redundant hydraulic systems on modern aircraft.

Another object is to provide hydraulic energy transfer means which are highly efficient and reliable in the rigourous environment of aircraft hydraulic systems.

Another object is to provide means for positively coupling the spider of a nutater device to pistons which are constrained to move in a linear direction.

Another object is to provide suitable valve means for rotary devices which have low start-up friction and long life.

Another object is to reduce the weight of hydraulic power transfer units to a minimum.

These objects and other advantages of the present invention will become apparent after considering the following detail specification which covers preferred embodiments thereof in conjunction with the accompanying drawings, wherein:

DETAILED DESCRIPTION OF THE PREFERRED EMBODIMENTS

Figure 1:
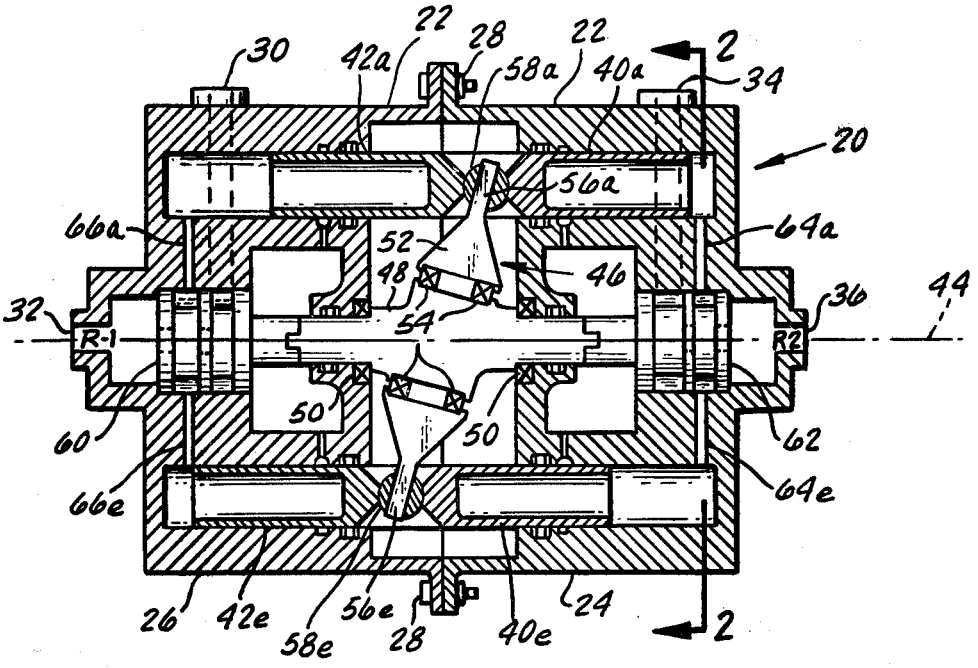
FIG. 1 is a simplified cross sectional view of a reciprocating motor pump unit constructed according to the present invention, the cross section being taken at line 1—1 in FIG. 2.

Referring to the drawings, more particularly by reference numbers, number 20, in FIG. 1 refers to a hydraulic power transfer unit constructed according to the present invention, the power transfer unit disclosed in FIG. 1 is shown in elemental form and is provided to explain the operation of such unit and not the mechanical details required to make such a unit practical, which details will be described hereinafter. The unit 20 is bidirectional, that is, it will transfer hydraulic energy in either direction between two hydraulic systems connected thereto. The unit transfers hydraulic energy from the system having a higher pressure to the system having a lower pressure by automatically sensing the differential pressure and reacting thereto.

The unit 20 includes a housing 22, which is shown in FIG. 1 as having a right hand half 24 and a left hand half 26, which are held together by suitable means such as the fasteners 28 shown. The housing half 26 includes at least one pressure port 30 and a return port 32 which usually are connected into a first hydraulic system while the housing half 24 has a pressure port 34 and a return port 36 which usually are connected to a second hydraulic system. Pressure port 30 receives hydraulic pressure from or supplies hydraulic pressure to system 1, while pressure port 34 provides the identical function to system 2. The return hydraulic fluid of system 1 which relatively is unpressurized enters or leaves the unit 20 through return port 32 while return port 36 provides the identical function for system 2.

Figure 2:
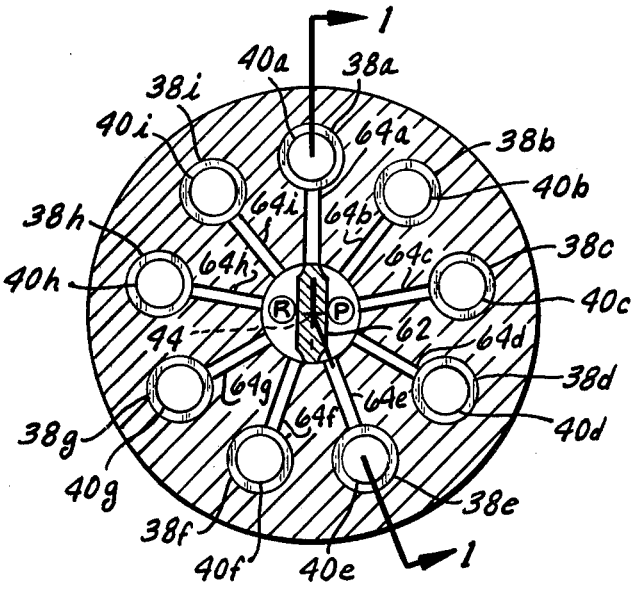
FIG. 2 is a cross sectional end view taken at line 2—2 in FIG. 1.

The housing 22 is provided with a plurality of cylindrical bores 38, a thru *i*, in each housing half 24 and 26 corresponding to an equal plurality of pairs of pistons 40*a* thru *i* and 42*a* thru *i*. The pistons 40 and 42 in each pair are arranged coaxially, one for each system, and the two pistons, 40 and 42 of each piston pair are interconnected to move together as shown in FIGS. 1 and 2. Nine piston pairs are provided which are disposed symmetrically and circumferentially about a central axis 44. The number of piston pairs provided is dependent upon the amount of pressure ripple that can be tolerated, and generally an odd number is desirable to reduce the harmonic content of any pressure fluctuation produced by the unit 20.

Each of the pairs of pistons 40 and 42 are mechanically interconnected to each of the other pairs by means of a nutator mechanism 46, which is provided to assure a predetermined phase relationship therebetween. The nutator mechanism 46 is mounted on a central shaft 48 journaled in a plurality of bearings 50. The central shaft 48 is rotated about its axis 44 by the nutator mechanism 46, which includes a spider 52, which is connected to the central shaft 48 at an acute angle with respect to the axis 44 by means of bearings 54. The spider 52 includes outwardly extending arms 56*a* thru *i*, of which 56*a* and 56*e* are shown in FIG. 1. The rods 56, by means of suitable interconnection means 58, connect to the associated pairs of pistons 40*a* thru *i*, and 42*a* thru *i*. Therefore the nutator mechanism 46 is constrained from rotation but nutates during operation, thereby to rotate the central shaft 48 as will be explained further.

The nutator spider 52 is actuated or nutated by the sequential repeating motion of the pairs of pistons 40*a* thru *i*, and 42*a* thru *i*, when the pistons pairs are moved by differential pressure applied thereacross. This differential hydraulic pressure is applied when either system 1 or system 2 has a lower than normal pressure. The application of the pressure is through suitable valves which are shown as rotary valves 60 and 62, whose operation can be more clearly understood with reference to FIG. 2. Each rotary valve, 60 and 62 essentially shifts flow from the pressure port 30 or 34 to generally one half of the pistons 40 and 42, while connecting the return port 32 or 36 to the other pistons. Of course, as shown in FIG. 2 with regard to piston 40*a*, there must be locatons which cease, at least momentarily, all flow into or out of the pistons as each piston reverses directions. When, for example, the pressure in system 1 is below that of system 2, this results in a differential pressure being applied across pistons 40*b* thru 40*e* when the unit 20 is in the position shown in FIGS. 1 and 2. As the pistons 40*b* thru 40*e* start to move to the left, the pistons 42*b* thru *e* also move to the left. The hydraulic fluid displaced by the movement of the pistons 42*b* thru *e* is conducted by means of the rotary valve 60 to the pressure port 30 through the passage ways 66*b* thru *e*, so that motion of the pistons 42*b* thru *e* tends to pressurize system 1. The movement of the pistons 40 and 42 also causes the spider 52 to nutate, which rotates the central shaft 48 to move the rotary valves 60 and 62 to a new valving position so that alternately each piston pair is valved to pressure and return, smoothly transferring hydraulic energy from one system to the other. Of course, when system 1 is the higher pressure system, the unit 20 transfers energy in the opposite direction since the pressure applied to the pistons by means of the valves 60 and 62 automatically will cause the nutator spider 52 to rotate in the opposite direction. It should be understood that many different types of valves such as flat plate valves may be substituted for the rotary valves diagramatically shown in FIGS. 1 and 2 without materially affecting the invention. However, it is important that the interconnection means 58 be such that positive positioning of the piston pairs with respect to the spider 52 is maintained at all times so that the phase relationship therebetween and between the rotary valves 60 and 62 is maintained. The construction of a preferred interconnection means is shown in detail in FIGS. 3, 4, and 5.

Figure 3:
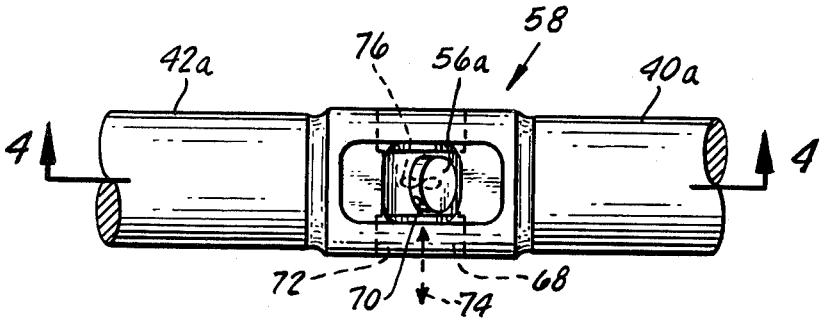
FIG. 3 is an enlarged detailed top view of the connection between the spider and the pistons in the unit of FIG. 1.
Figure 4:
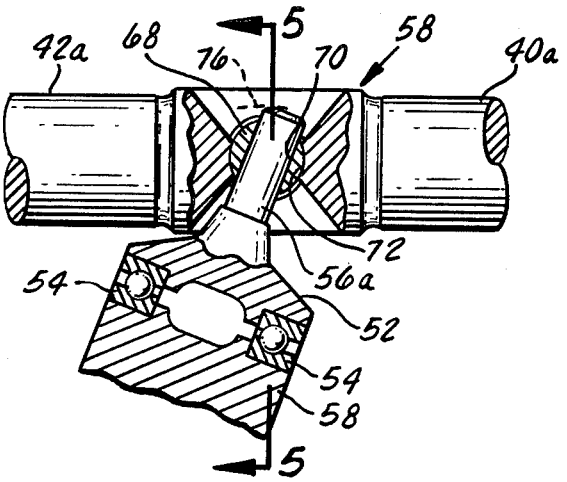
FIG. 4 is a cross sectional view taken at line 4—4 in FIG. 3.
Figure 5:
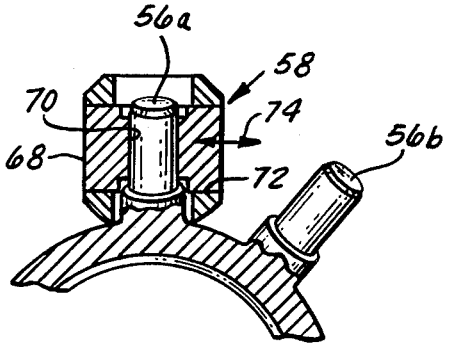
FIG. 5 is a cross sectional view taken at line 5—5 in FIG. 4.
Figure 6:
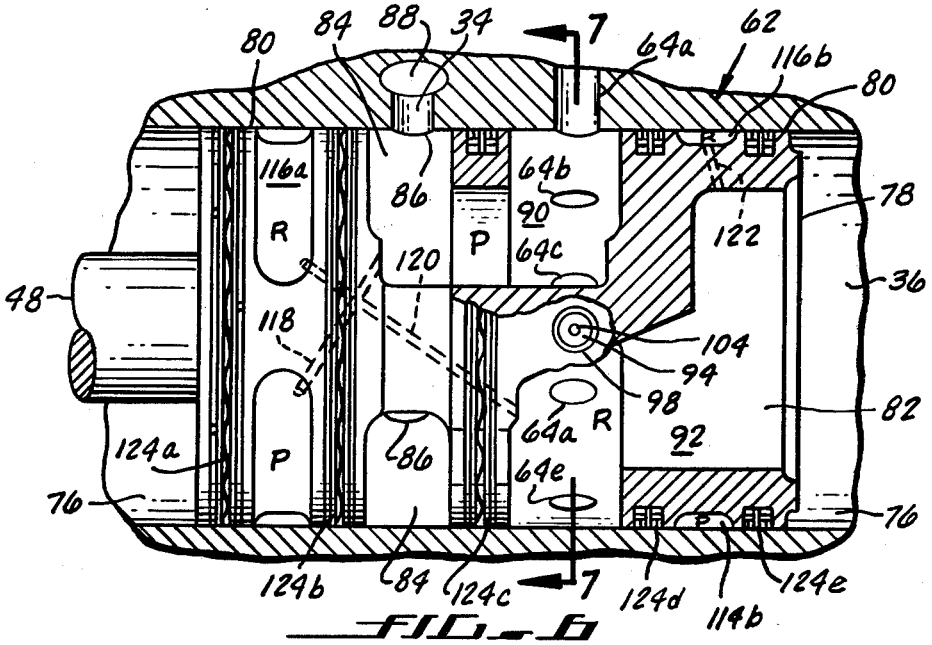
FIG. 6 is an enlarged detailed side view partially in cross section of the valving means as used in FIG. 1.
Figure 7:
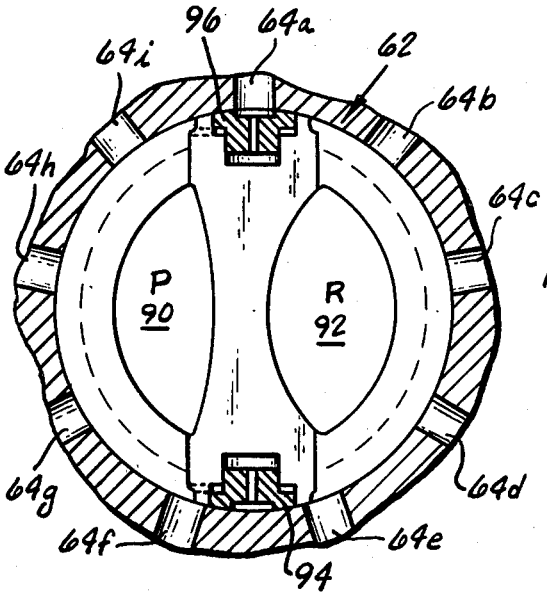
FIG. 7 is a cross sectional view taken at line 7—7 in FIG. 6 with the valve turned 90°.

The interconnection means 58 includes a bushing 68 having a cylindrical bore 70 therethrough, which bore 70 permits pivotal and sliding motion of the rod 56 retained therein (rod 56*a* being shown). The bushing 68 is mounted in a bore 72 in the interconnection means 38 which is generally at a right angle to the bore 70 in the bushing 68. This permits lateral motion of the rod 56*a* with respect to the pistons 40*a* and 42*a* as shown by arrow 74. Interconnection means like means 58 shown are required since the end of the rod 56*a* moves in a figure 8 path 76 with respect to the pistons 40*a* and 42*a* as shown in FIG. 3 which figure 8 path 76 is cylindrical when viewed from the side as shown in FIG. 4. The interconnection means 58 shown provides both sliding and pivotal engagement between the nutator mechanism 46 and the pistons 40 and 42 assuring complete motion freedom at the interconnection, yet maintaining finite positioning between the elements.

The details of suitable rotary valve means are shown in FIGS. 6, 7, 8, and 9, which are enlarged views of rotary valve 62, which can be mirror image identical to rotary valve 60. The rotary valve 62 is retained within a cylindrical housing 76 coaxial with the central shaft 48. The valve 62 includes a body portion 78, having an outer cylindrical surface 80 sized to fit in the cylindrical housing 76 and to rotate there within. The body portion 78 also includes a return port connection 82 at the end thereof opposite from the central shaft 48 and a radial pressure port ring 84 positioned to communicate with the formerly mentioned pressure port 34. The radial pressure port ring 84 may communicate with a plurality of passageways 86 in the cylindrical housing 76 connected together by a manifold 88. The radial pressure port ring 84 is connected in communication to the main pressure chamber 90 of the valve 62, whereas the return connection passageway 82 is connected to the main return chamber 92 thereof.

Figure 8:
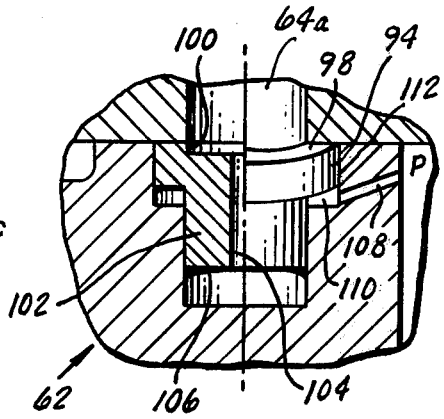
FIG. 8 is a detail view still further enlarged of the balanced vane use in the rotary valve configuration of FIGS. 6 and 7.

As the valve 62 rotates, it alternately switches the passageways 64*a* thru *i* to communicate between the main pressure chamber 90 and the main return chamber 92. This switching action can be seen more clearly with reference to FIGS. 7 and 8 since FIGS. 1 and 2 show very simplified valves. The actual switching is made by a pair of pressure balanced vanes 94 and 96, which are essentially identical. An enlarged view of vane 94 is shown in FIG. 8. It includes an upper sliding surface 98, having generally a cylindrical shape adapted for sliding contact with the cylindrical housing 76. The surface 98 preferably is lapped to the cylindrical housing 76. The surface 98 is toroidal in shape when viewed from the housing 78 with its inner diameter 100, preferably the same diameter as the diameter of the ports 64 and defining an area approximately equal to the area of each of the ports 64. The vane 98 also has a central body portion 102, which preferably is cylindrical in shape and has the same diameter as the inner diameter 100 mentioned previously. Vanes of other shapes such as oblong or oval could be used depending on the space restraints in the unit 20 but cylindrical vanes 98 are more economical to manufacture. A passageway 104 is provided through the central body portion 102 so that hydraulic fluid pressure, whether it be that in the pressure side or the return side, is passed thereto to act upon an area 106 which is equal to the area within the inner surface 100 minus the area of the passageway 104. This causes the force which presses the surface 98 against the cylinder housing 76 to be independent of the pressure within the port 64. This last mentioned force is created by providing a pressure connection 108 to a toroidal area 110 underneath surface 98. Since the cylindrical side surface 112 adjacent thereto is at right angles to the area 110 and the area above and below the side surface 112 are preferably equal, the size of the toroidal area 110 determines the force at which the surface 98 is applied against the cylindrical housing 76, and can be adjusted during design, so that the desired force is achieved. This of course assumes that the unit 20 is working normally to keep the pressures in the two systems up to almost normal levels.

The vanes 94 and 96 allow a lapped fit across the port 64 as they are being switched from pressure to return or vice versa, yet, since the pressure at which they are forced against the wall can be designed as desired, very low startup friction and running friction is achieved without needless complexity.

The area of the main pressure chamber 90 and the main return chamber 92 which acts against the cylindrical housing 76 tends to load the body portion 78 of the valve 62 toward the ports 64, which at that moment, are acting as return ports. Therefore, pressure and return balancing areas 114*a* and *b* and 116*a* and *b* are provided with pressure areas 114*a* and *b* being located 180° from the ports 64 connected to pressure and the return balance areas 116*a* and *b* being 180° from the return connected ports 64. The areas 114*a* and 114*b* equal the area of the cylindrical housing 76 to which pressure is applied and the return balance areas 116*a* and *b* equal the area of the cylindrical housing 76 to which return is applied. Suitable passageways 118 and 120 connect the areas 114*a*, and 116*a* respectively to pressure and return, and similar passageways such as passageway 122 are used for areas 114*b* and 116*b*.

By balancing the thrust loads produced by the pressure chamber 90 and the return chamber 92, friction is greatly reduced between the valve body 78 and the cylindrical housing 76 to provide excellent start-up and running efficiency.

Figure 9:
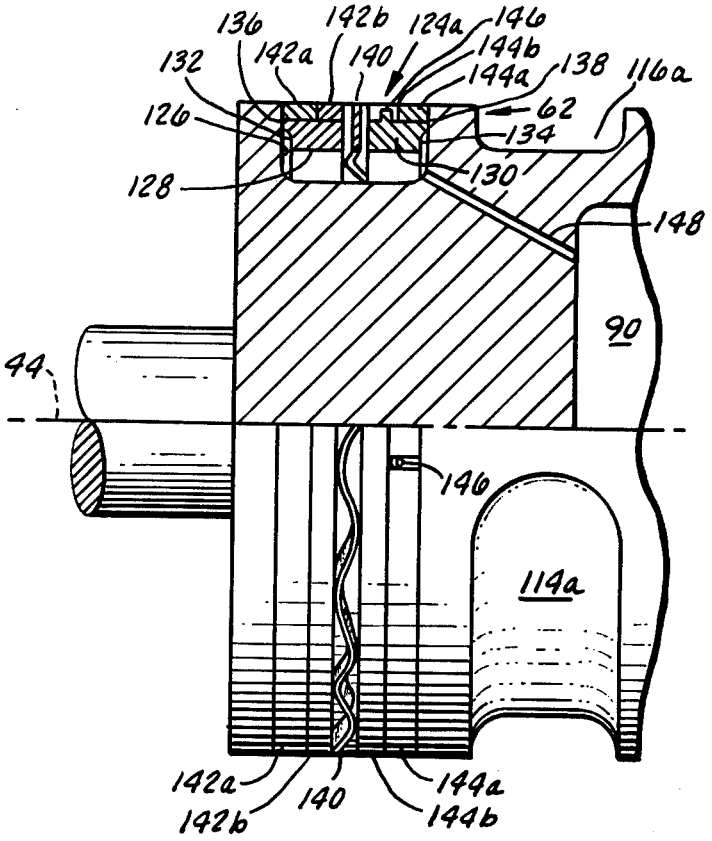
FIG. 9 is a detail view still further enlarged of the seals used in the rotary valve configuration of FIGS. 6 and 7.

Radial ring assemblies 124*a, b, c, d* and *e* are used about the circumferance of the valve body 78 with rings 124*a*, and 124*e* being positioned at the the ends thereof. Rings 124*b* and 124*d* are used to separate the balancing areas 114*a* and *b*, and 116*a* and *b* from the main chambers 90 and 92 and ring 124*c* is used to separate pressure from return. Since the ring assemblies 124 have loads applied thereacross which reverse about their circumferance, special assemblies are required, which are shown in detail in FIG. 9. The ring assembly 124*a*, shown in FIG. 9 is representative of all the ring assemblies 124 and is shown positioned in a ring groove 126 coaxial with the axis 44 thereof. The ring assembly 124*a* includes a pair of inner backup rings 128 and 130, whose radially opposite surfaces 132 and 134 include sidewardly extending projections 136 and 138. It is desirable to reduce the end area of the projections 136 and 138 to a minimum so that the friction generated between the projections 136 and 138, and the groove 126 is minimized. The rings 128 and 130 are energized against the side walls 139*a* and 139*b* of the groove 126 by a wave spring 140 positioned therebetween.

Each of the backup rings 128 and 130 has a pair of rings 142*a* and *b*, and 144*b* as shown. The rings are pinned by projections 146, which extend from adjacent rings into the gaps 147 therein. This assures that the gaps 147 in the rings never align themselves to cause a leak.

When used as shown, the rings 128, 130, 142*a* and *b*, and 144*a* and *b* are stationery within the cylindrical housing 76. Relative motion occurs at the sides of the rings, and the ring area wherein the relative motion occurs is reduced by providing the projections 136 and 138 to minimize friction between the rings and the rotary valve body portion 78 as aforesaid. The rings 128, 130, 142*a* and *b*, and 144*a* and *b* are energized outwardly by providing a connection 148 between the groove 126 and the main pressure chamber 90 so that pressurized fluid tends to expand the rings outwardly against the cylindrical housing 76 to assure that they remain stationery thereon.

Figure 10:
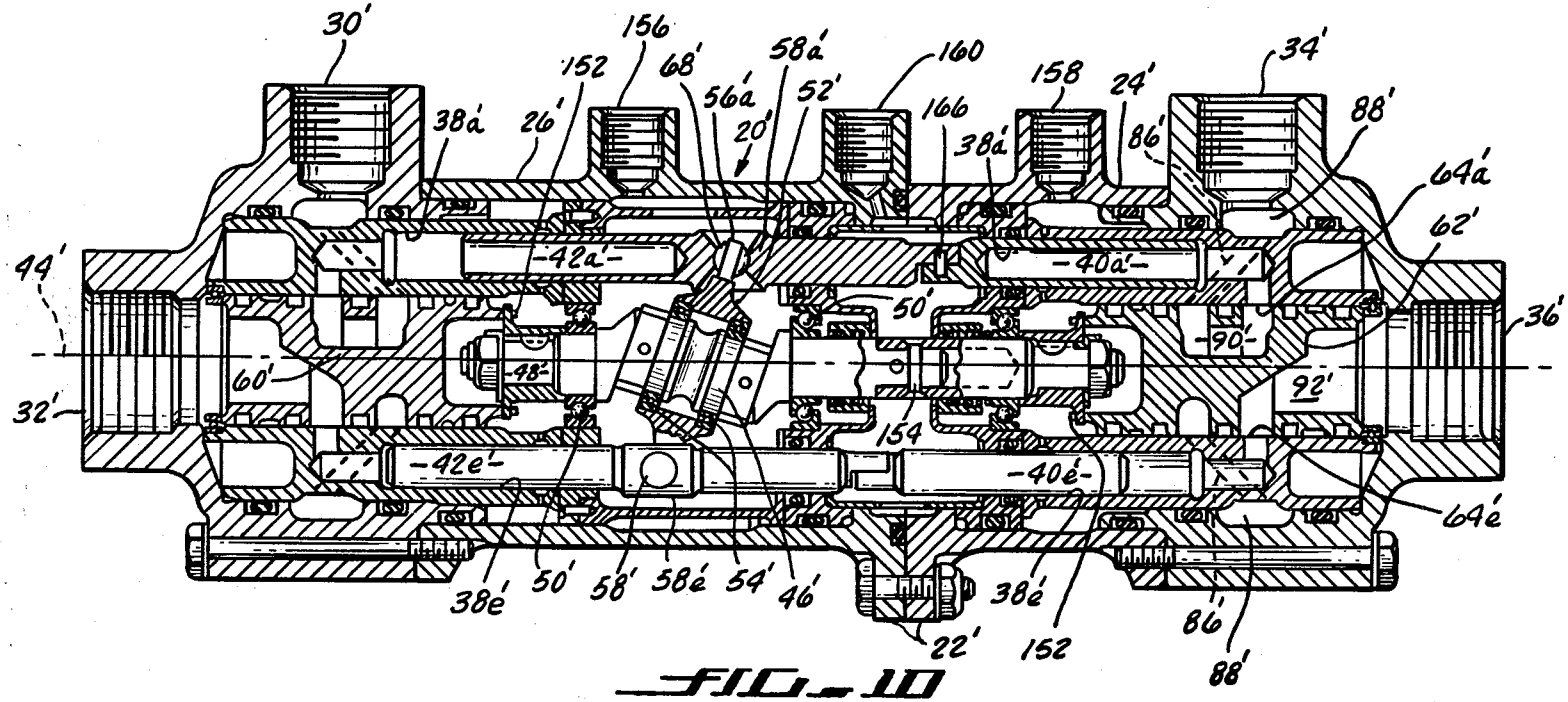
FIG. 10 is a cross sectional elevational view of a complete power transfer unit with its detail shown.

An actual production type design of the present invention is shown in FIG. 10 wherein the portions thereof previously discussed have been given the same numbers with a prime (′) added thereto. The additional features shown include those required so that mechanical breakage of the unit 20′ at any one location will not cause the loss of more than one hydraulic system. This is accomplished in part by providing keyed connections 152 between the central shaft 48′ and the rotary valves 60′ and 62′ and providing a shear pin connection 154 along the shaft 48′. Also shown is a case drain port 156 for system 1, a case drain port 158 for system 2 and a vent port 160 therebetween to drain off leakage fluid. Port 160 is the passageway through which hydraulic fluid may escape in the case of failure of one of the two systems within the unit 20′. The flow of fluid out of port 160 indicates failure of at least one system. It should also be noted that the pistons 42′ are connected to the pistons 40′ by slip joints 166 which allow a slight amount of misalignment between the pistons 40′ and 42′.

Thus there has been shown and described a novel automatic bi-directional hydraulic power transfer unit that causes the system with the higher input pressure to transfer hydraulic energy to the other. When the pressures of the two systems are essentially equal, that is, there is not enough pressure differential to overcome a predetermined amount of friction within the unit, the pistons will not move nor will the nutator mechanism be able nutate, and the whole unit stands still. Thus the unit fulfills all the objects and advantages sought therefor. Many changes, modifications, variations and other uses and applications of the subject invention however will become apparent to those skilled in the art after considering this specification and the accompanying drawings. All such changes modifications, alterations and other uses and applications which do not depart from the spirit and scope of the invention are deemed to be covered by the invention which is limited only by the claims which follow.

What is claimed is:

1. A reciprocating hydraulic power transfer unit for transfering hydraulic energy between first and second hydraulic systems each having a pressure side and a return side comprising:

a central axis;

a plurality of cylinders spaced about said central axis;

a plurality of first and second pistons connected back to back and mounted for sliding movement within said cylinders;

mechanical piston phase control means operatively connected to said pistons for holding said pistons in a constant relative positional relationship with each other; and hydraulic valve means coupled to said phase control means and arranged to connect the pressure sides of the first and second systems to act on said back to back pistons in at least one of said cylinders at a time in a cyclic sequence and simultaneously to connect the return sides of the first and second systems to act on said back to back pistons in at least one of said cylinders which are substantially diametrically opposite to said cylinders connected to the pressure side, whereby said unit is capable of operating as a motor and a pump, and fluid from the pressure line of the system with a predetermined greater pressure than the other system is operative to drive successive ones of said pistons in one direction while the connected back to back piston pressurizes the fluid in the pressure side of the other system, while opposite pistons are constrained by said phase control means to return in a reverse direction, said mechanical phase control means including:

a central shaft located on said central axis substantially symmetrically with respect to said pistons;

a connector ring having a plurality of substantially coplanar radial arms;

means for coupling said radial arms with corresponding ones of said pistons; and bearing means connecting said central shaft to said connector ring in such a way as to maintain the plane of said radial arms at a fixed angle with respect to said central axis but allowing said plane and said connector ring to wobble about said axis, whereby the positions of said pistons are interdependent and movement of one pair of back to back pistons results in corresponding movement of the others to maintain a constant phase relationship between said pistons, said hydraulic valve means including at least one rotary valve having:

a valve body defining an interior cylindrical surface and an area therewithin;

a pressure port in communication with said cylindrical surface area;

a return port in communication with said cylindrical surface area;

a plurality of flow passageways, each communicating the fluid acted upon by a piston pair to said cylindrical surface area; and a central valve member connected to said mechanical piston phase control means and mounted for rotation in said cylindrical surface area adapted to cyclically switch said flow passageways to communicate with said pressure and return ports in a preselected order, said central valve member including:

a main pressure chamber in communication with said pressure port;

a main return chamber in communication with said return port; and a divider portion positioned to communicate generally half of said flow passageways with said main pressure chamber and generally the other flow passageways with said return chamber, said divider portion including:

a pair of vanes positioned to slide over the locations at which said flow passageways terminate at said interior cylindrical surface; and a pair of orifices defined by said divider portion in which said vanes are mounted, said vanes each including:

a cylindrical main body portion having a vane passageway formed therethrough;

a cylindrical vane portion connected to said cylindrical main body portion at the end thereof which extends toward said interior cylindrical surface and concentric therewith;

a ring shaped surface formed on said cylindrical vane portion whose inner diameter is the same as the diameter of said cylindrical main body portion, said ring shaped surface having a surface contour which matches the contour of said interior cylindrical surface; and means to apply the pressure in the pressure line beneath said ring shaped surface so that the area thereof determines the force with which said ring shaped surface is held against said interior cylindrical surface.

2. The unit as defined in claim 1 wherein said flow passageways intersect said interior cylindrical surface at predetermined locations, the size and shape of the intersections being the same as the interior shape of said ring shaped surface.

3. A reciprocating hydraulic power transfer unit for transfering hydraulic energy between first and second hydraulic systems each having a pressure side and a return side comprising:

a central axis;

a plurality of cylinders spaced about said central axis;

a plurality of first and second pistons connected back to back and mounted for sliding movement within said cylinders;

mechanical piston phase control means operatively connected to said pistons for holding said pistons in a constant relative positional relationship with each other; and hydraulic valve means coupled to said phase control means and arranged to connect the pressure sides of the first and second systems to act on said back to back pistons in at least one of said cylinders at a time in a cyclic sequence and simultaneously to connect the return sides of the first and second systems to act on said back to back pistons in at least one of said cylinders which are substantially diametrically opposite to said cylinders connected to the pressure side, whereby said unit is capable of operating as a motor and a pump, and fluid from the pressure line of the system with a predetermined greater pressure than the other system is operative to drive successive ones of said pistons in one direction while the connected back to back piston pressurizes the fluid in the pressure side of the other system, while opposite pistons are constrained by said phase control means to return in a reverse direction, said hydraulic valve means including at least one rotary valve having:

a valve body defining an interior cylindrical surface and an area therewithin;

a pressure port in communication with said cylindrical surface area;

a return port in communication with said cylindrical surface area;

a plurality of flow passageways, each communicating the fluid acted upon by a piston of a piston pair to said cylindrical surface area; and a central valve member connected to said mechanical piston phase control means and mounted for rotation in said cylindrical surface area adapted to cyclically switch said flow passageways to communicate with said pressure and return ports in a preselected order, said central valve member including:

a main pressure chamber in communication with said pressure port;

a main return chamber in communication with said return port;

a divider portion positioned to communicate generally half of said flow passageways with said main pressure chamber and generally the other flow passageways with said return chamber;

an outer cylindrical surface;

at least one circumferential groove having radial side walls formed in said outer cylindrical surface; and a seal positioned in said groove having at least one outer surface for contact and stationary engagement with said inner cylindrical surface, opposite side surfaces positioned to engage said radial side walls for sliding contact therebetween, two adjacent pairs of sealing rings on whose outer surfaces form said outer surface of said seal, each pair having a side surface positioned to engage said groove side wall, a pair of backup rings which are positioned to bear outwardly on said two adjacent pairs of sealing rings, each having a side surface positioned to engage said groove side wall, and spring means positioned between said two adjacent pairs of sealing rings and between said backup rings to force said side wall engaging surfaces thereof into engagement with said side walls.

4. The unit as defined in claim 3 further including a passageway to connect said main pressure chamber beneath said backup rings.

5. A reciprocating hydraulic power transfer unit for transfer of energy but not fluid, between two hydraulic systems, said unit comprising:

first and second pluralities of cylinders spaced substantially uniformly about a central axis, corresponding pairs of said cylinders being axially aligned;

a central shaft coaxial with said axis;

an equal plurality of piston pairs mounted for sliding movement in corresponding pairs of said cylinders, each of said piston pairs being movable only as a pair;

mechanical piston phase control means for holding said piston pairs in a constant relative positional relationship with each other, said phase control means including:

a rigid plate having a plurality of substantially coplanar radial arms connected therewith;

means for coupling said radial arms to corresponding ones of said piston pairs to permit a combination of pivotal and sliding motion therebetween; and means for mounting said rigid plate on said central shaft and holding said plate at a constant angle with respect to said central axis while allowing said plate to nutate, without rotation about said axis, thereby rotating said shaft; and first and second hydraulic valve means coupled to said central shaft and arranged to cylindrically connect respective pressure lines of first and second hydraulic systems to groups of one or more adjacent ones of said first and second pluralities of cylinders and simultaneously to cylindrically connect respective return lines of said first and second hydraulic systems to substantially diametrically opposite groups of said first and second pluralities of cylinders, said first and second hydraulic valve means each including:

an annular chamber surrounding said shaft;

a plurality of passages communicating between respective ones of first or second pluralities of cylinders and said chamber;

a substantially diametric dividing wall attached to and rotatable with said shaft, to divide said chamber into two halves;

means for communicating the fluid in said pressure line to one of said chamber halves and the fluid in said return line to the other of said chamber halves, whereby the pressure line is connected to a cyclicly rotating group of approximately one contiguous half of said plurality of cylinders and the return line is connected to the other half, a rotary valve body coupled to said phase control means, said valve body being rotatable about said central axis;

a plurality of openings in each of said cylinders;

said valve body having at least one opening for connecting a first fluid line to one of said cylinders and for connecting a second fluid line to an opposite one of said cylinders, said valve body having internal openings for substantially equalizing the pressure differential between said first two openings; and a substantially cylindrical body, rotatable about the central axis, said rotatable body being provided with a first and a second semi-annular recess connectable respectively to one of said pressure lines and one of said return lines, said valve body having a first internal chamber connectable with the recess connectable to said return line, said semi-annular recesses and said chambers being so disposed about said cylindrical valve body and having such volume as to substantially equalize the pressures exerted thereon by said pressure and return lines, said valve means further including a plurality of piston rings disposed in said valve body, two of said piston rings being disposed laterally about one of said sets of semi-annular recesses and each of said piston rings being provided with an expander spring for forcing the piston ring radially outwardly.

* * * * *